US006844310B2

(12) United States Patent
Bauer et al.

(10) Patent No.: US 6,844,310 B2
(45) Date of Patent: Jan. 18, 2005

(54) PROCESS OF PREPARING A CRYSTALLINE SODIUM SILICATE BUILDER COMPOSITION

(75) Inventors: Harald Bauer, Kerpen (DE); Josef Holz, Erftstadt (DE); Günther Schimmel, Erftstadt (DE)

(73) Assignee: Clariant GmbH, Frankfurt (DE)

( * ) Notice: Subject to any disclaimer, the term of this patent is extended or adjusted under 35 U.S.C. 154(b) by 426 days.

(21) Appl. No.: 10/039,480

(22) Filed: Nov. 9, 2001

(65) Prior Publication Data

US 2002/0155982 A1 Oct. 24, 2002

(30) Foreign Application Priority Data

Nov. 14, 2000 (DE) ..... 100 56 346

(51) Int. Cl.[7] ..... C11D 7/14; C11D 7/08

(52) U.S. Cl. ..... 510/511; 510/531; 510/276; 510/334; 510/486

(58) Field of Search ..... 510/511, 531, 510/276, 334, 486

(56) References Cited

U.S. PATENT DOCUMENTS

| | | | | | |
|---|---|---|---|---|---|
| 4,664,839 | A | | 5/1987 | Rieck | |
| 5,378,388 | A | | 1/1995 | Pancheri | |
| 5,520,860 | A | | 5/1996 | Tapper et al. | |
| 5,540,855 | A | * | 7/1996 | Baillely et al. | 510/276 |
| 5,614,160 | A | * | 3/1997 | Gill et al. | 423/332 |
| 5,691,296 | A | * | 11/1997 | Agar et al. | 510/441 |
| 5,698,510 | A | * | 12/1997 | Wilkinson et al. | 510/444 |
| 5,776,893 | A | | 7/1998 | Borgstedt et al. | |
| 5,900,399 | A | | 5/1999 | Seiter et al. | |
| 5,919,747 | A | * | 7/1999 | Kazuta et al. | 510/444 |
| 6,288,016 | B1 | * | 9/2001 | Ramanan et al. | 510/357 |
| 6,395,694 | B1 | * | 5/2002 | Littau | 510/276 |
| 6,506,722 | B1 | * | 1/2003 | Bauer et al. | 510/511 |
| 2001/0009897 | A1 | | 7/2001 | Bauer et al. | |

FOREIGN PATENT DOCUMENTS

| | | |
|---|---|---|
| DE | 199 42 796 | 10/2000 |
| EP | 0 164 514 | 12/1985 |
| EP | 0 578 986 | 1/1994 |
| EP | 0 614 965 | 9/1994 |
| EP | 0 650 926 | 5/1995 |
| EP | 0 849 355 | 6/1998 |
| EP | 1 004 655 | 5/2000 |
| EP | 1 113 068 | 7/2001 |
| GB | 1 596 756 | 8/1981 |
| GB | 2 318 363 | 4/1998 |
| WO | 90/13533 | 11/1990 |

OTHER PUBLICATIONS

EPO Search Report for application No. 01126163, dated May 6, 2002.
English abstract for 0 578 986, Jan. 19, 1994.
U.S. application Ser. No. 09/448,246, filed Nov. 24, 1999.
English abstract for DE 19942796, Oct. 5, 2000.
English abstract for EP 0614965, Sep. 14, 1994.
English abstract for WO 90/13533, Oct. 31, 1990.
U.S. patent application No. 08/994,479, filed Dec. 19, 1997.
English abstract for JP 58–217598, Dec. 17, 1983.

* cited by examiner

*Primary Examiner*—Charles Boyer
(74) *Attorney, Agent, or Firm*—Richard P. Silverman

(57) ABSTRACT

The invention relates to builder compositions obtainable by bringing a) crystalline sheetlike sodium silicate of the formula $NaMSi_xO_{2x+1}.yH_2O$, where M is sodium or hydrogen, x is a number from 1.9 to 4 and y is a number from 0 to 20.
b) water and
c) an acidic, $H^+$-releasing component, where the
d) molar ratio of the crystalline sheetlike sodium silicate a) to the total amount of the releasable $H^+$ of the acid component c) is 4:1 to 1000:1 and the
e) molar ratio of the water b) to the total amount of the releasable $H^+$ of the acidic component c) is 3:1 to 1000:1.

into contact with one another.

The invention also relates to laundry detergents, cleaners, compounds and water softeners comprising the builder compositions according to the invention.

22 Claims, No Drawings

PROCESS OF PREPARING A CRYSTALLINE SODIUM SILICATE BUILDER COMPOSITION

BACKGROUND OF THE INVENTION

The impetus to save energy during washing and cleaning processes, e.g. during machine washing of textiles and dishwashing, demands an ever greater reduction in water consumption. Laundry detergents and cleaners based on water-insoluble builder systems, such as zeolite, or partially soluble systems, such as crystalline sheetlike sodium disilicate, thus noticeably reach the limit of their performance. A negative consequence of reducing the water consumption is observed, for example, when washing textiles, in particular dark colored textiles, in the form of white residues on the fabrics, which originate from undissolved or poorly dispersed builder.

EP 0 650 926 describes the granulation of crystalline sheetlike sodium disilicate by roll compaction with the addition of hardening agents such as water, silica sol, silica gel, surfactants, water glass, maleic acid-acrylic acid polymers and other copolymers. The aim is the preparation of granules resistant to mechanical abrasion.

EP 0 849 355 describes a pulverulent laundry detergent and cleaner component which comprises a reaction product of an alkaline silicate and an acidic polycarboxylate. The specification describes a preparation process which comprises applying an acidic polycarboxylate solution to an alkaline silicate, the processing preferably being carried out using a solids mixer and a spraying device.

U.S. Pat. No. 5,540,855 describes a particulate composition consisting of crystalline phyllosilicate and a solid water-ionizable material chosen from the group of organic acids, where the mixing ratio of silicate to acid is approximately 3.5:1 and the content of nonbonded moisture is less then 5% by weight.

It was an object of the present invention to provide a builder composition which has improved dissolution residue behavior.

SUMMARY OF THE INVENTION

Surprisingly, it has now been found that builder compositions based on crystalline sheetlike sodium silicate, which are obtainable by bringing crystalline sheetlike sodium silicate into contact with water and an acidic, $H^+$-releasing component in a certain ratio, where the resulting builder compositions are then advantageously mechanically and/or thermally after-treated, exhibit improved dissolution residue behavior.

Accordingly, the invention provides a builder composition obtainable by bringing crystalline sheetlike sodium silicate of the formula $NaMSi_xO_{2x+1}.yH_2O$, where M is sodium or hydrogen, x is a number from 1.9 to 4 and y is a number from 0 to 20, water and an acidic, $H^+$-releasing component, where the molar ratio of the crystalline sheetlike sodium silicate a) to the total amount of the releasable $H^+$ of the acid component c) is 4:1 to 1000:1 and the molar ratio of the water b) to the total amount of the releasable $H^+$ of the acidic component c) is 3:1 to 1000:1, into contact with one another.

The components a), b) and c) can be brought into contact by all processes which ensure adequate contact of the components with one another. Mention may be made here only of mixing and spraying techniques.

The water b) and/or the acidic component c) can also be brought into contact in the gaseous or vapor state with the crystalline sheetlike sodium silicate a). Advantageously, the components a), b) and c) are brought into contact with one another by mixing. Examples of suitable mixers are Lödige mixers, ploughshare mixers, Eyrich mixers and Schugi mixers. The mixing times are preferably 0.5 s to 60 min, particularly preferably 2 s to 30 min. For the mixing, all mixing variants are conceivable which ensure adequate thorough mixing of the components a), b) and c). In a preferred embodiment, the acidic component c) and the water b) are firstly mixed and then the resulting mixture is mixed with the crystalline sheetlike sodium silicate a). In a further embodiment, the acidic component c) is firstly mixed with the crystalline sheetlike sodium silicate a), and then the water b) is mixed in. In a still further embodiment, the water b) is firstly mixed with the crystalline sheetlike sodium silicate a), and then the acidic component c) is mixed in. Also possible is an embodiment in which the acidic component c) is mixed with some of the water b), then is mixed with the crystalline sheetlike sodium silicate a) and finally the remainder of the water b) is mixed in.

The addition of the water b) and the acidic component c) to the crystalline sheetlike sodium silicate a) can be carried out at ambient temperature, but also at elevated temperature. Preference is given to temperatures of from 0 to 400° C., particularly preferably from 10 to 200° C. The heat can be introduced by external heating. Where appropriate, all the components or only certain components can be preheated.

Observance of the molar ratios given under points d) and e) is of essential importance for the invention. The molar ratio d) of the crystalline sheetlike sodium silicate a) to the total amount of the releasable $H^+$ of the acidic component c) is preferably 5:1 to 550:1, particularly preferably 15:1 to 150:1. The molar ratio e) of the water b) to the total amount of the releasable $H^+$ of the acidic component c) is preferably 4:1 to 110:1, particularly preferably 6:1 to 85:1. The sodium silicates a) are preferably those with x values of 2, 3 or 4. Particular preference is given to sodium disilicates $Na_2Si_2O_5.yH_2O$ where x is 2. The sodium silicates a) may also be mixtures.

Crystalline sheetlike sodium disilicate is composed of variable percentage fractions of the polymorphic phases alpha, beta, delta and epsilon. In commercial products, amorphous fractions may also be present. Preferred crystalline sheetlike sodium silicates a) comprise 0 to 40% by weight of alpha-sodium disilicate, 0 to 40% by weight of beta-sodium disilicate, 40 to 100% by weight of delta-sodium disilicate and 0 to 40% by weight of amorphous fractions. Particularly preferred crystalline sheetlike sodium silicates a) comprise 7 to 21% by weight of alpha-sodium disilicate, 0 to 12% by weight of beta-sodium disilicate and 65 to 95% by weight of delta-sodium disilicate. Particular preference is given to crystalline sheetlike sodium silicates a) with a content of from 80 to 100% by weight of delta-sodium disilicate. In a further embodiment, it is also possible to use crystalline sheetlike sodium silicates a) with a content of from 80 to 100% by weight of beta-sodium disilicate.

The abovementioned alpha-sodium disilicate corresponds to the Na SKS-5 described in EP-B-0 164 514, characterized by the X-ray diffraction data given therein which are assigned to the alpha-$Na_2Si_2O_5$, whose X-ray diffraction diagrams have been registered with the Joint Committee of Powder Diffraction Standards with the numbers 18-1241, 22-1397, 22-1397A, 19-1233, 19-1234 and 19-1237.

The abovementioned beta-sodium disilicate corresponds to the Na SKS-7 described in EP-B-0 164 514, characterized by the X-ray diffraction data given therein which are assigned to the beta $Na_2Si_2O_5$, whose X-ray diffraction diagrams have been registered with the Joint Committee of Powder Diffraction Standards with the numbers 24-1123 and 29-1261.

The abovementioned delta-sodium disilicate corresponds to the Na SKS-6 described in EP-B-0 164 514, characterized by the X-ray diffraction data given therein which are assigned to the delta-$Na_2Si_2O_5$, whose X-ray diffraction diagrams have been registered with the Joint Committee of Powder Diffraction Standards with the number 22-1396.

In a particular embodiment, the crystalline sheetlike sodium silicates a) comprise additional cationic and/or anionic constituents. The cationic constituents are preferably alkali metal ions and/or alkaline earth metal cations and/or Fe, W, Mo, Ta, Pb, Al, Zn, Ti, V, Cr, Mn, Co and/or Ni. The anionic constituents are preferably sulfates, fluorides, chlorides, bromides, iodides, carbonates, hydrogencarbonates, nitrates, oxide hydrates, phosphates and/or borates.

In a particular embodiment, the crystalline sheetlike sodium silicates comprise, based on the total content of $SiO_2$, up to 10 mol % of boron. In a further preferred embodiment, the crystalline sheetlike sodium silicates comprise, based on the total content of $SiO_2$, up to 20 mol % of phosphorus. The crystalline sheetlike sodium silicate is preferably used as a powder with an average particle size of from 0.1 to 4000 $\mu$m, particularly preferably 10 to 500 pm, particularly preferably 20 to 200 $\mu$m.

The acidic $H^+$-releasing component c) may be an inorganic acid, an organic acid, an acidic salt or a mixture thereof. The acidic component c) is preferably a protonic acid whose anion contains boron, carbon, silicon, nitrogen, phosphorus, arsenic, antimony, sulfur, selenium, tellurium, fluorine, chlorine, and/or bromine, a monocarboxylic acid, a dicarboxylic acid, a tricarboxylic acid, an oligocarboxylic acid, a polycarboxylic acid, a homo- and/or copolymer based on monomers of acrylic acid, maleic acid, vinylsulfonic acid, vinyl acetate, aspartic acid and/or sugar carboxylic acid, sodium hydrogensulfate and/or sodium hydrogencarbonate. Particularly suitable polycarboxylic acids are also those described in GB-A-1,596,756.

A particularly preferred acid component c) is sulfuric acid, a silicic acid, a sulfonic acid, phosphoric acid, a phosphonic acid, particularly preferably 1-hydroxyethane-1,1-diphosphonic acid and aminopolymethylenephosphonic acid, hydrochloric acid, boric acid, carbonic acid, acetic acid, citric acid, ascorbic acid, glutaric acid, gluconic acid, glucolic acid, succinic acid, tartaric acid, hydroxysuccinic acid, maleic acid, malonic acid, oxalic acid, a polyacrylic acid with a molecular weight of from 200 to 10000 g/mol, a copolymer based on acrylic acid and maleic acid with a molecular weight of from 2000 to 70000 g/mol and/or sodium hydrogensulfate. Especially preferred as acidic component c) is sulfuric acid, a silicic acid, acetic acid, citric acid, a polyacrylic acid with a molecular weight of from 1000 to 5000 g/mol, a copolymer based on monomers of acrylic acid and maleic acid with a molecular weight of from 4000 to 70000 g/mol and/or sodium hydrogensulfate. A very particularly preferred acidic component c) is sulfuric acid. The acidic component c) preferably has a $pK_s$ value of less than 11.

Advantageously, the composition obtained after bringing the components a), b) and c) into contact is also mechanically and/or thermally further-treated. In a preferred embodiment, the composition obtained after bringing the components a), b) and c) into contact is ground and then optionally fractionated according to size. Surprisingly, the grinding effects make an improvement in the dissolution residue behavior. The grinding is preferably carried out using vibratory mills, bead mills, roller mills and pendulum roller mills (e.g. those from Neuman & Esser), hammer mills, impact mills or air jet mills (e.g. those from Hosokawa-Alpine). The ground material is classified into oversize material, acceptable material and undersize material, preferably by screening and/or sieving. Sieving is particularly preferably suitable. Suitable sieves are, for example, those from Rhewum, Locker and Allgeier.

In a further preferred embodiment, the composition obtained after bringing the components a), b) and c) into contact is compacted, then ground and then optionally fractionated according to size. Surprisingly, the compacting step leads to a further improvement in the dissolution residue behavior. The compaction is preferably roll compaction, press granulation or briquetting, particularly preferably roll compaction. The temperature of the material during the compaction is preferably between 10 and 200° C., where the desired temperature can be controlled by external heating/cooling or adjusts by itself as a result of the frictional heat which is released. In the case of roll compaction, the pressing force is preferably between 2 and 200 kN/cm roll width, particularly preferably between 10 and 100 kN/cm roll width. Examples of suitable roll compactors are those from Hosokawa-Bepex and Alexanderwerk. The flakes which form during roll compaction are comminuted using mills of a suitable type and optionally fractionated according to size. The compaction can be carried out discontinuously in a batch procedure, or else continuously. In the case of continuous operation, the undersize material is fed back into the compactor and the oversize material is passed back into the mill in a recycling operation. During the compaction, it is possible to add, where appropriate, up to 10% by weight of compacting auxiliaries, preferably water, water glass, polyethylene glycols, nonionic surfactants, anionic surfactants, polycarboxylate copolymers, modified and/or unmodified celluloses, bentonites, hectorites, saponites and/or other laundry detergent ingredients.

Surprisingly, it has also been found that heat treatment of the builder composition leads to a further improvement in the dissolution residue behavior. The heat treatment can be carried out directly after the components a), b) and c) have been brought into contact, or else it can be carried out after compaction, after grinding or after fractionation according to size. Two or more heat treatments at various processing stages are also within the meaning of the invention. The heat treatment is preferably carried out at temperatures between 30 and 400° C., particularly preferably between 40 and 150° C. The duration of the heat treatment is preferably 0.5 to 1000 min, particularly preferably 2 to 120 min. Suitable apparatuses for the heat treatment are, for example, fluidized beds, belt and tunnel furnaces, fly conveyors and storage containers. Particular preference is given to a process in which, after the components a), b) and c) have been brought into contact, the mixture is firstly heat-treated, then compacted, then ground and then optionally fractionated according to size. Particular preference is also given to a process in which, after the components a), b) and c) have been brought into contact, the mixture is firstly compacted, then ground, then optionally fractionated according to size and then heat-treated.

The builder composition according to the invention is preferably used as a powder with an average particle size of from 0.1 to 4000 $\mu$m, particularly preferably 10 to 500 $\mu$m, especially preferably 20 to 200 μm. In a further preferred embodiment, the builder composition according to the invention is used as granules having an average particle size of from 200 to 2000 μm, preferably 400 to 900 μm. Likewise preferred is the use of the builder composition according to the invention as ground granules having an average particle size of from 0.1 to 300 μm, preferably 10 to 200 μm.

Also preferred are the builder compositions according to the invention wherein the dissolution residue of a 0.25% strength aqueous solution, at 20° C. and after stirring for 20 minutes, is less than or equal to 50%, preferably less than or equal to 30%.

The invention also provides laundry detergents and cleaners comprising at least one of the builder compositions according to the invention. The laundry detergents are preferably heavy-duty detergents, compact heavy-duty detergents, compact color detergents, heavy-duty detergents of low bulk density, special detergents, such as, for example, stain-removal salts, bleach boosters, curtain detergents, wool detergents, modular detergents and commercial detergents. The cleaners are preferably machine dishwashing detergents. Because of their good soil dispersal, their high alkalinity and because of their protective action for glass, silicates are desired in this context. Glass damage is understood here as meaning either the formation of layered deposits on glassware and also the erosion of the glass surface—both lead to the known undesired dulling of glassware.

Preferred laundry detergents and cleaners comprise 0.5 to 99% by weight of the builder composition according to the invention optionally 0.5 to 80% by weight, preferably 5 to 50% by weight, of cobuilders optionally 1 to 50% by weight, preferably 2 to 30% by weight, of interface-active substances optionally 1 to 70% by weight, preferably 5 to 50% by weight, of bleaching systems optionally 0.5 to 80% by weight, preferably 5 to 50% by weight, of pH regulators to 100% by weight of further customary ingredients.

Particularly preferred laundry detergents and cleaners comprise 0.5 to 99% by weight of the builder composition according to the invention 0.5 to 80% by weight, preferably 5 to 50% by weight, of cobuilders optionally 1 to 50% by weight, preferably 2 to 30% by weight, of interface-active substances optionally 1 to 70% by weight, preferably 5 to 50% by weight, of bleaching systems optionally 0.5 to 80% by weight, preferably 5 to 50% by weight, of pH regulators to 100% by weight of further customary ingredients.

Further particularly preferred laundry detergents and cleaners comprise 0.5 to 99% by weight of the builder composition according to the invention 1 to 50% by weight, preferably 2 to 30% by weight, of interface-active substances optionally 0.5 to 80% by weight, preferably 5 to 50% by weight, of cobuilders optionally 1 to 70% by weight, preferably 5 to 50% by weight, of bleaching systems optionally 0.5 to 80% by weight, preferably 5 to 50% by weight, of pH regulators to 100% by weight of further customary ingredients.

Further particularly preferred laundry detergents and cleaners comprise 0.5 to 99% by weight of the builder composition according to the invention optionally 1 to 70% by weight, preferably 5 to 50% by weight, of bleaching systems optionally 0.5 to 80% by weight, preferably 5 to 50% by weight, of cobuilders optionally 1 to 50% by weight, preferably 2 to 30% by weight, of interface-active substances optionally 0.5 to 80% by weight, preferably 5 to 50% by weight, of pH regulators to 100% by weight of further customary ingredients.

Further particularly preferred laundry detergents and cleaners comprise 0.5 to 99% by weight of the builder composition according to the invention 0.5 to 80% by weight, preferably 5 to 50% by weight, of pH regulators optionally 0.5 to 80% by weight, preferably 5 to 50% by weight, of cobuilders optionally 1 to 50% by weight, preferably 2 to 30% by weight, of interface-active substances optionally 1 to 70% by weight, preferably 5 to 50% by weight, of bleaching systems to 100% by weight of further customary ingredients.

Further particularly preferred laundry detergents and cleaners comprise 0.5 to 99% by weight of the builder composition according to the invention 0.5 to 80% by weight, preferably 5 to 50% by weight, of cobuilders optionally 1 to 50% by weight, preferably 2 to 30% by weight, of interface-active substances, optionally 1 to 70% by weight, preferably 5 to 50% by weight, of bleaching systems optionally 0.5 to 80% by weight, preferably 5 to 50% by weight, of pH regulators to 100% by weight of further customary ingredients.

Further particularly preferred laundry detergents and cleaners comprise 0.5 to 99% by weight of the builder composition according to the invention 0.5 to 80% by weight, preferably 5 to 50% by weight, of cobuilders 1 to 50% by weight, preferably 2 to 30% by weight, of interface-active substances, 1 to 70% by weight, preferably 5 to 50% by weight, of bleaching systems optionally 0.5 to 80% by weight, preferably 5 to 50% by weight, of pH regulators to 100% by weight of further customary ingredients.

Further particularly preferred laundry detergents and cleaners comprise 0.5 to 99% by weight of the builder composition according to the invention 0.5 to 80% by weight, preferably 5 to 50% by weight, of cobuilders 1 to 50% by weight, preferably 2 to 30% by weight, of interface-active substances, 1 to 70% by weight, preferably 5 to 50% by weight, of bleaching systems 0.5 to 80% by weight, preferably 5 to 50% by weight, of pH regulators to 100% by weight of further customary ingredients.

Special laundry detergents and cleaners comprise 1 to 50% by weight, e.g. heavy-duty detergents, color detergents, water softeners and stain-removal salts, or 60 to 100% by weight, e.g. modular laundry detergent systems, of the builder composition according to the invention.

Other special laundry detergents and cleaners, e.g. machine dishwashing detergents, comprise 1 to 30% by weight of the builder composition according to the invention.

The cobuilders are preferably crystalline alumosilicates, mono-, oligomeric or polymeric or copolymeric carboxylic acids, alkali metal carbonates, alkali metal orthophosphates, alkali metal pyrophosphates and alkali metal polyphosphates, crystalline phyllosilicates, crystalline alkali metal silicates without layer structure and/or X-ray amorphous alkali metal silicates.

The bleach systems are preferably active chlorine carriers and/or organic or inorganic active oxygen carriers, bleach activators (e.g. TAED), bleach catalysts, enzymes for removing discolorations, perborates and/or percarbonates.

The interface-active substances are preferably anionic, cationic, nonionic and/or zwitterionic surfactants.

Preferred nonionic surfactants are alkali metal alkoxylates, gluconamides and/or alkyl polyglycosides. Among the alkyl alkoxylates, preference is given to using ethoxylated alcohols, preferably primary alcohols, having preferably 8 to 22 carbon atoms and preferably 1 to 80 EO units per mole of alcohol, where the alcohol radical is linear or preferably methyl-branched in the 2-position or contain a mixture of methyl-branched radicals, as is usually the case in oxo alcohol radicals. The preferred ethoxylated alcohols include, for example, $C_{11}$-alcohols having 3, 5, 7, 8 and 11 EO units, ($C_{12}$–$C_{15}$)-alcohols having 3, 6, 7, 8, 10 and 13 EO units, ($C_{14}$–$C_{15}$)-alcohols having 4, 7 and 8 EO units, ($C_{16}$–$C_{18}$)-alcohols having 8, 11, 15, 20, 25, 50 and 80 EO units and mixtures thereof. The given degrees of ethoxylation are random average values which may be an integer or a fraction for a specific product. In addition to these, it is also possible to use fatty alcohol-EO/PO adducts, such as, for example, the ®Genapol grades 3970, 2909 and 2822 from Clariant GmbH.

Further suitable surfactants are polyhydroxy fatty acid amides of the formula $R_2$-CO-N($R_3$)-Z, in which $R_2$CO is an aliphatic acyl radical having 6 to 22 carbon atoms, $R_3$ is hydrogen, an alkyl or hydroxyalkyl radical having 1 to 4 carbon atoms and Z is a linear or branched polyhydroxyalkyl radical having 3 to 10 carbon atoms and 3 to 10 hydroxyl groups. Preference is given to using alkyl glycosides of the general formula $RO(G)_x$, where R is a primary straight-chain or methyl-branched, in particular methyl-branched in the 2-position, aliphatic radical having 8 to 22, preferably 12 to 18, carbon atoms, and G is a glycose unit having 5 or 6 carbon atoms, preferably glucose. The degree of oligomerization x, which gives the distribution of monoglycosides and oligoglycosides, is preferably a number between 1 and 10, and x is particularly preferably between 1.2 and 1.4. Preference is given to using alkoxylated, preferably ethoxylated or ethoxylated and propoxylated fatty acid alkyl esters, preferably having 1 to 4 carbon atoms in the alkyl chain, in particular fatty acid methyl esters, as are described, for example, in Japanese patent application JP 58/217598, or preferably those prepared in accordance with the process described in International patent application WO A 90/13533.

Suitable anionic surfactants of the sulfonate type are preferably the known ($C_9$–$C_{13}$)-alkylbenzenesulfonates, alpha-olefinsulfonates and alkanesulfonates. Also suitable are esters of sulfo fatty acids and the disalts of alpha-sulfo fatty acids. Further suitable anionic surfactants are sulfated fatty acid glycerol esters, which are mono-, di- and triesters, and mixtures thereof, as are obtained in the preparation by esterification by 1 mol of monoglycerol with 1 to 3 mol of fatty acid or in the transesterification of triglycerides with 0.3 to 2 mol of glycerol. Suitable alkyl sulfates are, in particular, the sulfuric monoesters of ($C_{12}$–$C_{18}$)-fatty alcohols, such as lauryl, myristyl, cetyl or stearyl alcohol and the fatty alcohol mixtures obtained from coconut oil, palm oil and palm kernel oil, which may additionally also comprise fractions of unsaturated alcohols, e.g. oleyl alcohol. Further suitable anionic surfactants are, in particular, soaps. Saturated fatty acid soaps are suitable, such as the salts of lauric acid, myristic acid, palmitic acid, stearic acid, hydrogenated erucic acid and behenic acid, and in particular those soap mixtures derived from natural fatty acids, for example, coconut, palm kernel or tallow fatty acids. The anionic surfactants can be in the form of their sodium, potassium or ammonium salts, and in the form of soluble salts of organic bases, such as mono-, di- and triethanolamine. The anionic surfactants are preferably in the form of their sodium or potassium salts, in particular in the form of the sodium salts. The pH regulators are preferably soda, citric acid, sodium citrate and/or bicarbonate.

Finally, the laundry detergents and cleaners can optionally also comprise enzymes, such as, for example, protease, amylase, lipase and cellulase.

The invention also provides components for laundry detergent modular systems which preferably comprise 60 to 100% by weight of the builder composition according to the invention.

The invention further provides water softeners which comprise at least one of the builder compositions according to the invention. Water softeners exercise a performance-increasing effect on the wash result and a protective effect with regard to the washing machine primarily in regions with a high water hardness.

Preferred water softeners comprise a) 0.5 to 99% by weight of the builder composition according to the invention b) optionally 0.5 to 80% by weight of cobuilders c) optionally 0 to 15% by weight of interface-active substances d) optionally 0.5 to 80% by weight of pH regulators. Preferred components a), b), c) and d) are the compounds listed above.

The builder composition according to the invention can expressly also be used as a component for the preparation of compounds for laundry detergents and cleaners, water softeners and laundry detergent modular systems. Using compounds, it is possible to achieve special effects. Thus, for example, liquid components can be incorporated into pulverulent or tablet-shaped laundry detergents and cleaners. Furthermore, the coloration or mottling of laundry detergents and cleaners is possible. It is likewise possible to thereby achieve special disintegration effects, better dispersion of poorly dispersible components or the porosity of tablets.

The compounds preferably comprise a) 70 to 99.5% by weight of the builder composition according to the invention, preferably as powder having average particle sizes of from 1 to 500 $\mu$m, particularly preferably 20 to 100 $\mu$m, or in another embodiment preferably as granules having an average particle size of from 200 to 2000 μm, preferably 300 to 900 μm, and b) 0.5 to 30% by weight of anionic, cationic, nonionic and/or zwitterionic surfactants. As surfactants c), preference is given to using the compounds listed above.

Other preferred compounds comprise a) 50 to 99% by weight of the builder composition according to the invention, b) 0.01 to 10% by weight of dye c) to 100% by weight of further customary ingredients.

The laundry detergents, cleaners, water softeners and modular components can be used, for example, in powder form, granule form, gel form, liquid form or tablet form. To prepare the tablets, the respective composition is compressed using a tableting press to the appropriate shape, which may take various forms (e.g. cylindrical, quadratic, ellipsoidal, circular etc.). In the case of the cylindrical form, the ratio of radius to height may be between 0.2 and 5. The pressing force can be between 12 and 0.3 kN/cm$^2$. The pressing force is essentially independent of the geometric shape of the tablet. For the tableting of machine dishwashing detergents, pressing forces of from 0.7 to 14.2 kN/cm$^2$ are preferred, and forces of from 2.8 to 10 kN/cm$^2$ are particularly preferred. Also preferred is multistage compression which gives more complex shapes. Division into various compartments thus have a certain separation of ingredients otherwise incompatible with one another. For multilayer tablets, any parts of the formulation are pressed into two or more stages one after the other, resulting in number of layers. In the case of a two-layer tablet, particular preference is given to a layer thickness ratio of the two layers of from 1:10 to 10:1. Other use forms are, for example, tablets with incorporated spherical compartments. The various layers and compartments of the tablets can also be differently colored.

EXAMPLES

The examples below serve to illustrate the invention without, however, limiting it.

Determination of the phase composition of the crystalline sheetlike sodium disilicates used:

A triturated solid sample is measured in a Philips PW1710 X-ray powder diffractometer (CuK alpha 2-ray radiation, wavelength 1.54439 Angström, accelerating potential 35 kV, heating current 28 mA, monochromator, scanning rate 3 degrees 2 theta per minute). The measured intensities are evaluated as follows:

| substance | characteristic peak (d value in Angström) |
|---|---|
| alpha phase | 3.29 +/− 0.07, typically 3.31 |
| beta phase | 2.97 +/− 0.06 |
| delta phase | 3.97 +/− 0.08 |

The crystalline fractions in percentage by weight are calculated from the intensities $I_a$, $I_b$ and $I_d$—measured in pulses—of the alpha, beta and delta phase according to the following formulae:

alpha content: $A[\%]=100*I_a/(I_a+I_b+I_d)$ beta content: $B[\%]=1.41*100*I_b/(I_a+I_d)$ delta content: $D[\%]=100-A-D$ To determine the X-ray amorphous fraction (AM), the background (pulse) of the X-ray peak is determined at a d value of 2.65 Angström ($I_{am}$) and converted to a percentage content using the following empirical formula:

$$AM[\%]=(I_{am}-70)*100/450$$

If, in an analysis, X-ray amorphous fractions are also mentioned in addition to the crystalline fractions, then the contents A, B, C are corrected by AM.

Compaction and grinding of the builder compositions:

In a roll compactor (Hosokawa-Bepex), the starting material is conveyed between the compactor rollers using a stopping screw (setting column stage 5). This is done at a rate such that a pressing force of from 10 to 100 kN/cm of roller length arises. The roller rotation is set at stage 3 to 7, and the roller gap is 0.1 mm. The resulting flakes (length about 50 mm, thickness about 2 to 5 mm, width about 10 to 15 mm) are crushed in a hammer mill (UPZ model, Alpine) with a perforation diameter of 5 mm at a rotary speed of from 600 to 1400 rpm. From the crushed pulverulent product are removed oversize material (screen with perforation diameter 1000 μm) and undersize material (screen with perforation diameter 300 μm). The oversize material is subjected to a further grinding step and again screened. The two fractions with particle size between 300 μm and 1000 μm are combined.

Determination of the particle distribution of the builder compositions by screen analysis:

The inserts having the desired screens are inserted into a Retsch screening machine. Here, the mesh width of the screen decreases from top to bottom. 50 g of the powder to be investigated are placed onto the widest screen. As a result of the vibratory movement of the screening machine, the powder material is conveyed through the various screens. The residues on the screens are weighed and calculated on the basis of the initial weight of material. The $d_{50}$ value can be calculated from the results.

Preparation of the test detergents:

The optical brighteners are stirred into a quarter of the amount of molten alkyl ethoxylate and mixed with half the amount of soda or bicarbonate or phosphate in a domestic multimixer (Braun). In a Lödige plowshare mixer, the remaining soda and the total amount of builder composition according to the invention, phosphate, zeolite, bicarbonate, citric acid and polymer are mixed at 300 rpm for 15 minutes. Half of the remaining alkyl ethoxylate is then sprayed on over the course of 5 minutes. The builder composition according to the invention is then added, and the mixture is mixed for 10 minutes. The remaining second half of the alkyl ethoxylate is then sprayed on over the course of a further 5 minutes. Then, alkanesulfonate, polyvinylpyrrolidone, alkylbenzenesulfonate, soap, antifoam, phosphonate and compound with optical brightener are added, and the mixture is after-mixed at 300 rpm for 10 minutes. In a tumble mixer, the mixture from the Lödige mixer is admixed, with low shear stress, with percarbonate, perborate, TAED and enzymes and mixed for 5 minutes.

Tableting of laundry detergents:

For the tableting, the laundry detergent formulations are mixed and pressed to the appropriate shape using a Matra tableting press. The pressing force can be between 12 and 0.3 kN/cm$^2$. The compacts have a height of about 18 mm and a diameter of 41 mm.

Preparation of the machine dishwashing detergents:

The solid components, apart from enzymes, bleaches and perfume, are introduced into a Lödige plowshare mixer and thoroughly mixed. The alkyl ethoxylate is then sprayed on. Enzymes, perfume and bleaching system are finally mixed in.

Carrying out the dissolution residue test:

800 ml of tap water (water hardness: 20 degrees German hardness, molar ratio of Ca:Mg=about 4:1) are heated to 20° C. 2 g of the test substance are added and the mixture is stirred for 20 min using a magnetic stirrer. Using the gentle vacuum of a water jet pump, the dispersion is sucked into a Büchner funnel (diameter about 95 mm, model WFK 10A from wfk-Testgewebe GmbH, Christenfeld 10, 41379 Brueggen, Germany) through a cotton fabric. The screen is dried at 80 to 100° C. for 1 hour in a convection drying oven. The increase in weight is based on the initial weight, normalized to percentages and referred to as dissolution residue (KRT in %).

Example 1 (Comparison)

The dissolution residue, the bulk density and the average particle diameter $d_{50}$ are determined for commercially available crystalline sheetlike sodium disilicate granules (SKS-6 granules, Clariant GmbH). The results are summarized in table 1.

Example 2 (Comparison)

The dissolution residue is determined for a commercially available crystalline sheetlike sodium disilicate powder (SKS-6 powder, Clariant GmbH). The results are summarized in table 1. X-ray powder diffractometry reveals the following phase composition: alpha-disilicate 19.1% by weight, beta-disilicate 9.4% by weight and alpha-disilicate 71.5% by weight.

Example 3

In a Lödige plowshare mixer, crystalline sheetlike sodium disilicate powder from example 2 is mixed, in four batches, with a solution of 96% strength sulfuric acid and water in the quantitative ratios as given in table 1 to give a total of 18 kg of powder mixture. The dissolution residue of the powder mixture is determined. Compared with the untreated powder from example 2, the dissolution residue behavior is improved (see table 1 and cf. example 2).

Example 4

8 kg of the mixture from example 3 are incorporated in a roll compactor at a pressing force of 32 kN/cm of roller length. Approximately 3 kg of acceptable-size material are obtained, for which the dissolution residue is determined. The additional compacting effects improved dissolution residue behavior (see table 1 and cf. example 3).

Example 5

10 kg of the mixture from example 3 are heat-treated in a drying cabinet at 75° C. for 1 h. As a result of the high-temperature storage, the dissolution residue behavior is improved (see table 1 and cf. example 3).

Example 6

The material from example 5 is processed in a roll compactor at a pressing force of 32 kN/cm of roller length. Approximately 5 kg of acceptable material are obtained, for which the dissolution residue is determined (see table 1). The dissolution residue behavior is improved compared with examples 1, 2, 3, 4 and 5. Using X-ray powder diffractometry it can be seen that the proportions of the polymorphous disilicate phases have not changed: alpha-disilicate 19.3%, beta-disilicate 9.9%, delta-disilicate 70.8%.

Example 7

4 kg of the material from example 6 are ground using a ball mill U 280A0 from Welte, which is lined on the inside with metal and whose drum rotates at about 50 rpm. The grinding media used are 44 kg porcelain balls. As a result of the grinding, the dissolution residue behavior is improved compared with the granules from example 6 (see table 1 and cf. example 6).

Example 8 (Comparison)

In a Lödige plowshare mixer, crystalline sheetlike sodium disilicate powder from example 2 is mixed with a solution of 96% strength sulfuric acid and water in the quantitative ratios given in table 1 to give 9 kg of powder mixture. The mixture is heat-treated in a drying cabinet for 1 hour at 85° C. and then processed in a roll compactor at a pressing force of 32 kN/cm of roller length. Approximately 4 kg of acceptable-size material are obtained, for which the dissolution residue is determined (see table 1). The water-to-acid ratio, which is lower than in example 6, brings about a poorer dissolution residue behavior.

Example 9

In a Lödige plowshare mixer, crystalline sheetlike sodium disilicate powder from example 2 is mixed in two batches with a solution of 96% sulfuric acid and water in the quantitative ratios given in table 1 to give 9 kg of powder mixture. The mixture is heat-treated at 85° C. for 1 hour in a drying cabinet and then processed in a roll compactor at a pressing force of 32 kN/cm of roller length. Approximately 4 kg of acceptable-size material are obtained, for which the dissolution residue is determined (see table 1). Despite the smaller amount of acid/water used, the dissolution residue behavior is just as good as in example 6.

Example 10

In a Lödige plowshare mixer, crystalline sheetlike sodium disilicate powder from example 2 is mixed in two batches with a solution of 96% sulfuric acid and water in the quantitative ratios given in table 1 to give 9 kg of powder mixture. The mixture is heat-treated in a drying cabinet for 1 h at 85° C. and then processed in a roll compactor at a pressing force of 100 kN/cm of roller length. Approximately 4 kg of acceptable-size material are obtained, for which the dissolution residue is determined (see table 1). Despite the high amount of acid/water used, the dissolution residue behavior is just as good as in example 6.

Example 11

In a Lödige plowshare mixer, crystalline sheetlike sodium disilicate powder from example 2 is mixed in two batches with a solution of 96% sulfuric acid and water in the quantitative ratios given in table 1 to give 9 kg of powder mixture. The mixture is heat-treated in a drying cabinet for 10 min at 100° C. and then processed in a roll compactor at a pressing force of 32 kN/cm of roller width. Approximately 4 kg of acceptable-size material are obtained, for which the dissolution residue is determined (see table 1). Despite the different conditions during the heat treatment, the dissolution residue behavior is just as good as in example 6.

Example 12

In a Lödige plowshare mixer, crystalline sheetlike sodium disilicate powder from example 2 is mixed in two batches with a solution of 96% sulfuric acid and water in the quantitative ratios given in table 1 to give 9 kg of powder mixture. The mixture is heat-treated in a drying cabinet for 1 h at 85° C. and then processed in a roll compactor at a pressing force of 100 kN/cm of roller width. Approximately 4 kg of acceptable-size material are obtained, for which the dissolution residue is determined (see table 1). Despite the different pressing force, the dissolution residue behavior is just as good as in example 6.

Example 13 (Comparison)

The dissolution residue is determined for another commercially available crystalline sheetlike sodium disilicate powder (SKS-6 powder, Clariant GmbH). The results are summarized in table 1. X-ray powder diffractometry reveals the proportions of the the polymorphic disilicate phases: alpha-disilicate 9.8% by weight, beta-disilicate 1,7% and delta-disilicate 88.5% by weight. A comparison of the phase compositions and dissolution residues of examples 13 and 2 reveals that a higher delta-phase content leads to a more favorable effect. The effect achieved by increasing the delta-phase proportion is approximately equivalent to that achieved by simply mixing crystalline sheetlike sodium disilicate powder with water and sulfuric acid (cf. examples 2 and 3).

Example 14

In a Lödige plowshare mixer, crystalline sheetlike sodium disilicate powder from example 13 is mixed in two batches with a solution of 96% sulfuric acid and water in the quantitative ratios given in table 1 to give 9 kg of powder mixture. The mixture is heat-treated in a drying cabinet for 1 hour at 85° C. and then processed in a roll compactor at a pressing force of 32 kN/cm of roller width. Approximately 4 kg of acceptable-size material are obtained, for which the dissolution residue is determined (see table 1). The dissolution residue is more favorable than in example 13. X-ray powder diffractometry reveals that the phase distribution of the sodium disilicate has not changed: alpha-disilicate 10.6%, beta-disilicate 0%, delta-disilicate 89.4%.

Example 15 (Comparison)

The dissolution residue is determined for a pulverulent laundry detergent and cleaner component prepared in accordance with EP 0 849 355 (see table 1).

Example 16

In a Lödige plowshare mixer, crystalline sheetlike sodium disilicate powder from example 13 is mixed in two batches with a solution of acidic polycarboxylate (Stockhausen, grade W78230, 45% strength solution, 9.5 mmol of $H^+$/g of active substance) and water in the quantitative ratios given in table 1 to give 9 kg of powder mixture. The mixture is heat-treated at 85° C. in a drying cabinet for 1 h and then processed in a roll compactor at a pressing force of 50 kN/cm of roll width. Approximately 4 kg of acceptable-size material are obtained, for which the dissolution residue is determined (see table 1). As a result of the higher water-to-acid ratio and the compaction, the dissolution residue behavior is significantly better than in the case of comparative example 15.

Example 17

In a Lödige plowshare mixer, crystalline sheetlike sodium disilicate powder from example 13 is mixed in two batches with a solution of acidic polycarboxylate (Stockhausen, grade W78230, 45% strength solution, 9.5 mmol of $H^+$/g of active substance) and water in the quantitative ratios as given in table 1 to give 9 kg of powder mixture. The mixture is not heat-treated but directly processed in a roll compactor with a pressing force of 50 kN/cm of roller width. Approximately 4 kg of acceptable-size material are obtained, for which the dissolution residue is determined (see table 1). The dissolution residue behavior is significantly better than in the case of comparative example 15.

Example 18

In a Lödige plowshare mixer, crystalline sheetlike sodium disilicate powder from example 13 is mixed in two batches with a solution of 90% acetic acid and water in the quantitative ratios given in table 1 to give 9 kg of powder mixture. The mixture is heat-treated at 80° C. for 1 h in a drying cabinet and then processed in a roll compactor at a pressing force of 50 kN/cm of roller width. Approximately 4 kg of acceptable-size material are obtained, for which the dissolution residue is determined (see table 1). The dissolution residue behavior is significantly better than in the case of comparative example 13.

Example 19

In a Lödige plowshare mixer, crystalline sheetlike sodium disilicate powder SKS-6 from example 13 is mixed in two batches with a solution of citric acid and water in the quantitative ratios given in table 1 to give 9 kg of powder mixture. The mixture is heat-treated at 80° C. for 1 h in a drying cabinet and then processed in a roll compactor at a pressing force of 50 kN/cm of roller width. Approximately 4 kg of acceptable-size material are obtained, for which the dissolution residue is determined (see table 1). The dissolution residue behavior is significantly better than in the case of comparative example 13.

Example 19a

In accordance with U.S. Pat. No. 5,540,855, crystalline sheetlike sodium disilicate powder SKS-6 from Example 13 is mixed, in a Lödige plowshare mixer in two batches, with citric acid in the quantitative ratios given in table 1 to give 9 kg of powder mixture. The mixture is processed in a roll compactor at a pressing force of 50 kN/cm of roller width. Approximately 4 kg of acceptable-size material are obtained, for which the dissolution residue is determined (see table 1). The dissolution residue behavior is significantly poorer compared with example 19.

Example 20

In a Lödige plowshare mixer, crystalline sheetlike sodium disilicate powder from example 13 is mixed in two batches with a solution of precipitated silica (grade Sipernat 22 S, Degussa) and water in the quantitative ratios given in table 1 to give 9 kg of powder mixture. The mixture is heat-treated at 80° C. in a drying cabinet for 1 hour and then processed in a roll compactor at a pressing force of 50 kN/cm of roller width. Approximately 4 kg of acceptable-size material are obtained, for which the dissolution residue is determined (see table 1). The dissolution residue behavior is significantly better than in the case of comparative example 13.

Example 21

In a Lödige plowshare mixer, crystalline sheetlike sodium disilicate powder from example 13 is mixed in two batches with a solution of sodium hydrogensulfate and water in the quantitative ratios given in table 1 to give 9 kg of powder mixture. The mixture is heat-treated at 80° C. for 1 hour in a drying cabinet and then processed in a roll compactor at a pressing force of 50 kN/cm of roller width. Approximately 4 kg of acceptable-size material are obtained, for which the dissolution residue is determined (see table 1). The dissolution residue behavior is significantly better than in the case of comparative example 13.

Examples 22 to 26 and 29 to 34

Test detergents having the compositions given in table 2 are prepared in accordance with the general procedure "Preparation of the test detergents".

Example 27

In a Lödige plowshare mixer, a water softener formulation according to table 2 is prepared, the solid components being mixed for 15 minutes at 300 rpm. The alkyl ethoxylate is melted and sprayed on with mixing.

Example 28

Detergent tablets having compositions according to table 2 are prepared in accordance with the general procedure "Preparation of the test detergents" and "Tableting of detergents".

Example 35

In a Lödige plowshare mixer, a stain-removal salt formulation according to table 2 is prepared, the solid components being mixed for 15 minutes at 300 rpm. The alkanesulfonate is melted and sprayed on with mixing.

Examples 36 to 38

Machine dishwashing detergents having the compositions according to table 3 are prepared in accordance with the general procedure "Preparation of the machine dishwashing detergents".

Example 39

A machine dishwashing detergent gel having the composition given in table 4 is prepared by mixing water glass, phosphate, soda, sodium hydroxide, phosphonate, polymer, alkanesulfonate, phosphoric esters together in a disperser (Ultraturrax, Hanke and Kunkel). The builder composition according to the invention in accordance with example 6 and sodium hypochlorite were finally mixed in.

Chemicals Used:

| | |
|---|---|
| AE 1 | ® Genapol 3070, Clariant GmbH |
| AE 2 | ® Genapol 2822, Clariant GmbH |
| Alkanesulfonate | ® Hostapur SAS 60, Clariant GmbH |
| Alkylbenzenesulfonate | ® Marlon ARL, Hüls |
| Antifoam | ® 11 Plv ASP3, Wacker |
| Citric acid | Jungbunzlauer |
| CMC | ® Tylose 2000, Clariant GmbH |
| Enzyme 1 | ® Termamyl 60T, Solvay Enzymes |
| Enzyme 2 | ® Termamyl 120T, Solvay Enzymes |
| Enzyme 3 | ® Savinase 6.0 TW, Solvay Enzymes |
| NaDCC | Olin Chemicals |
| Sodium acetate th | Merck KgaA |
| Sodium bicarbonate | Solvay |
| Sodium chloride | Merck KgaA |
| Sodium citrate th | Jungbunzlauer |
| Sodium hydroxide | Microprills 100%, Riedel-de Haen |
| Sodium hypochlorite | Celanese GmbH |
| Sodium metasilicate ph | VanBaerle |
| Sodium perborate mh | Degussa |
| Sodium perborate th | Degussa |
| Sodium percarbonate | ® Oxyper C, Solvay Interox |
| Sodium phosphate 1 | Sodium tripolyphosphate, Thermphos Intl. |
| Sodium phosphate 2 | ® Makrophos 1018, BK Giulini |
| Sodium phosphate 3 | ® Thermphos NW coarse, Thermphos Intl. |
| Sodium sulfate | Solvay |
| Sodium water glass | 45.5% active substance, modulus 2.0, Clariant France SA |
| Opt. Brightener | ® Tinopal CBS-X, Ciba |
| Perfume | Lemon perfume 78122D, Orissa |
| Phosphonate 1 | ® Dequest 2041, Monsanto |
| Phosphonate 2 | ® Dequest 200, Monsanto |
| Polycarboxylate 1 | ® Sokalan CP5 powder, BASF |
| Polycarboxylate 2 | ® Sokalan CP45, BASF |
| Polycarboxylate 3 | ® Sokalan CP5 liquid, BASF |
| Polyvinylpyrrolidone | ® Sokalan HP50, BASF |
| Soap | ® Liga base soap HM11E |
| Soda | Heavy soda, Matthes & Weber |
| Soil release polymer | ® SRC 1, Clariant GmbH |
| TAED 1 | ® Peractive AN, Clariant GmbH |
| TAED 2 | ® Peractive AC White, Clariant GmbH |
| Zeolite A | ® Wessalith P, Degussa |

TABLE 1

| Examples | 1 Comp | 2 Comp | 3 | 4 | 5 | 6 | 7 | 8 Comp | 9 | 10 | 11 |
|---|---|---|---|---|---|---|---|---|---|---|---|
| SKS-6 (% by wt.) | 96.5 | 99.8 | 93.5 | 93.5 | 93.5 | 93.5 | 93.5 | 94.24 | 98.65 | 86.88 | 93.5 |
| $H_2SO_4$ (% by wt.) | — | — | 0.48 | 0.48 | 0.48 | 0.48 | 0.48 | 2.88 | 0.1 | 3.88 | 0.48 |
| H-Polymer (% by wt.) | — | — | — | — | — | — | — | — | — | — | — |
| HAc (% by wt.) | — | — | — | — | — | — | — | — | — | — | — |
| $H_3Cit$ (% by wt.) | — | — | — | — | — | — | — | — | — | — | — |
| $SiO_2$ (% by wt.) | — | — | — | — | — | — | — | — | — | — | — |
| $NaHSO_4$ (% by wt.) | — | — | — | — | — | — | — | — | — | — | — |

TABLE 1-continued

| | | | | | | | | | | | |
|---|---|---|---|---|---|---|---|---|---|---|---|
| $H_2O$ (% by wt. | 3.5 | 0.2 | 6.02 | 6.02 | 6.02 | 6.02 | 6.02 | 2.88 | 1.25 | 9.24 | 6.02 |
| $nH_2O/nH+$ *) | — | — | 34.2 | 34.2 | 34.2 | 34.2 | 34.2 | 2.7 | 34.1 | 6.5 | 34.2 |
| NSKS-6/nH+ **) | — | — | 104.9 | 104.9 | 104.9 | 104.9 | 104.9 | 17.6 | 531.1 | 12.1 | 104.9 |
| Storage temp. (° C.) | — | — | — | — | 75 | 75 | 75 | 85 | 85 | 85 | 100 |
| Pressing force (kN/cm) | — | — | — | 32 | — | 32 | 32 | 32 | 32 | 32 | 32 |
| Dissolution residue (%) | 65 | 90 | 78 | 37 | 47 | 12 | 9 | 78 | 15 | 17 | 14 |
| Bulk density (g/L) | 910 | 600 | — | — | 606 | 750 | 853 | — | — | — | — |
| d50 (μm) | 680 | 110 | — | — | 105 | 665 | 21 | — | — | — | — |

| Examples | 12 | 13 Comp | 14 | 15 Comp | 16 | 17 | 18 | 19 | 19a Comp | 20 | 21 |
|---|---|---|---|---|---|---|---|---|---|---|---|
| SKS-6 (% by wt.) | 93.5 | 99.9 | 93.5 | 75.7 | 93.2 | 93.8 | 92.04 | 97.00 | 78.00 | 88.2 | 93.5 |
| $H_2SO_4$ (% by wt.) | 0.48 | — | 0.48 | | — | — | — | — | — | — | — |
| H-Polymer (% by wt.) | — | — | — | 18.0 | 1.9 | 0.5 | — | — | — | — | — |
| HAc (% by wt.) | — | — | — | | — | — | 0.59 | — | — | — | — |
| $H_3Cit$ (% by wt.) | — | — | — | | — | — | — | 0.75 | 22 | — | — |
| $SiO_2$ (% by wt.) | — | — | — | | — | — | — | — | — | 4.9 | — |
| $NaHSO_4$ (% by wt.) | — | — | — | — | — | — | — | — | — | — | 0.5 |
| $H_2O$ (% by wt. | 6.02 | 0.1 | 6.02 | 6.3 | 5.0 | 5.7 | 7.38 | 2.25 | 0.00 | 6.9 | 6 |
| $nH_2O/nH+$ *) | 34.2 | — | 34.2 | 2.0 | 15.3 | 66.7 | 41.9 | 10.7 | 0.0 | 4.7 | 80.0 |
| NSKS-6/nH+ **) | 104.9 | — | 104.9 | 2.4 | 28.5 | 108.4 | 51.6 | 136.4 | 3.7 | 5.9 | 123.3 |
| Storage temp. (° C.) | 85 | — | 85 | — | 85 | — | 80 | 80 | 80 | 80 | 80 |
| Pressing force (kN/cm) | 100 | — | 32 | — | 50 | 50 | 50 | 50 | 50 | 50 | 50 |
| Dissolution residue (%) | 10 | 78 | 4 | 76 | 2 | 1.3 | 8 | 6 | 60 | 4 | 2 |
| Bulk density (g/L) | — | — | 980 | 535 | — | 830 | — | — | — | — | — |
| d50 (μm) | — | — | 552 | 600 | — | 610 | — | — | — | — | — |

*) Molar ratio e)
**) Molar ratio d)

TABLE 2

| Examples | | 22 | 23 | 24 | 25 | 26 | 27 | 28 | 29 |
|---|---|---|---|---|---|---|---|---|---|
| Phyllosilicate from Ex. 6 | (% by wt.) | 45 | 15 | — | 10 | 10 | 15 | 12 | 20 |
| Phyllosilicate from Ex. 14 | (% by wt.) | — | — | 5 | — | — | — | — | — |
| Phyllosilicate from Ex. 16 | (% by wt.) | — | — | — | — | — | — | — | — |
| Zeolite A | (% by wt.) | — | 20 | 20 | — | 30 | 40 | 13 | 31 |
| Sodium phosphate 1 | (% by wt.) | — | — | — | 25 | — | — | — | — |
| Polycarboxylate 1 | (% by wt.) | — | 6 | 3 | — | 7 | 7 | 8 | 5 |
| Soda | (% by wt.) | — | 13 | 18 | — | — | 15 | 10 | — |
| Sodium bicarbonate | (% by wt.) | 15 | — | — | — | 18 | 5 | — | — |
| Sodium perborate mh | (% by wt.) | — | 18 | — | — | — | — | — | — |
| Sodium perborate th | (% by wt.) | — | — | 20 | 20 | — | — | — | — |
| Sodium percarbonate | (% by wt.) | 18 | — | — | — | — | — | 10 | — |
| TAED 1 | (% by wt.) | 5 | 5 | 2.5 | — | — | — | 5 | — |
| Alkylbenzenesulfonate | (% by wt.) | — | 9 | 9 | 6.7 | 8 | — | 14 | 10 |
| Alkanesulfonate | (% by wt.) | — | — | — | — | — | — | — | — |
| AE 1 | (% by wt.) | 10 | 8 | 5 | 2.2 | 10 | 2 | 4 | 25 |
| Soap | (% by wt.) | — | 1.5 | — | — | 1 | 2 | 1.5 | — |
| Antifoam | (% by wt.) | 1 | 1 | 0.6 | 0.6 | 1 | — | 1 | — |
| Enzyme 1 | (% by wt.) | 1.5 | 1.5 | 0.6 | 0.6 | 1.5 | — | 1 | 1.5 |
| Enzyme 3 | (% by wt.) | 1.5 | 1.5 | 0.6 | 0.6 | 1.5 | — | 1 | 1.5 |
| Opt. Brightener | (% by wt.) | 0.5 | 0.5 | 0.2 | 0.2 | — | — | 0.5 | — |
| Phosphonate1 | (% by wt.) | 0.2 | — | 0.1 | 0.1 | 0.2 | — | 0.2 | — |
| Citric acid | (% by wt.) | — | — | — | — | 2 | 5 | 5 | — |
| Polyvinylpyrrolidone | (% by wt.) | — | — | — | — | 1 | — | — | — |
| Soil release polymer | (% by wt.) | — | — | — | — | 0.8 | — | 1 | — |
| CMC | (% by wt.) | — | — | — | — | 1 | — | — | — |
| Sodium sulfate | (% by wt.) | 2.3 | — | 15.4 | 34 | 7 | 9 | 5.8 | 6 |
| Sodium chloride | (% by wt.) | — | — | — | — | — | — | — | — |
| Acetate th | (% by wt.) | — | — | — | — | — | — | 7 | — |
| Dosing | — | 65 g | 72 g | 135 g | 135 g | 72 g | 30 g | 2*40 g | 0.5 g/l |

| Examples | | 30 | 31 | 32 | 33 | 34 | 35 |
|---|---|---|---|---|---|---|---|
| Phyllosilicate from Ex. 6 | (% by wt.) | — | — | 4 | — | — | 9 |
| Phyllosilicate from Ex. 14 | (% by wt.) | 20 | — | — | 12 | — | — |
| Phyllosilicate from Ex. 16 | (% by wt.) | — | 40 | — | — | 5 | — |
| Zeolite A | (% by wt.) | 31 | 16 | 29 | — | — | — |

TABLE 2-continued

| | | | | | | | |
|---|---|---|---|---|---|---|---|
| Sodium phosphate 1 | (% by wt.) | — | — | — | — | — | — |
| Polycarboxylate 1 | (% by wt.) | — | 3 | 3 | 2 | 2 | — |
| Soda | (% by wt.) | 5 | 5 | 40 | 29 | 76 | 34 |
| Sodium bicarbonate | (% by wt.) | — | — | — | — | — | — |
| Sodium perborate mh | (% by wt.) | — | — | — | — | 3 | — |
| Sodium perborate th | (% by wt.) | — | — | — | — | 2 | — |
| Sodium percarbonate | (% by wt.) | — | — | — | — | — | 21 |
| TAED 1 | (% by wt.) | — | — | — | — | — | 7 |
| Alkylbenzenesulfonate | (% by wt.) | 30 | — | 7 | 6.5 | — | — |
| Alkanesulfonate | (% by wt.) | — | — | 9 | 4.5 | 9 | 4 |
| AE 1 | (% by wt.) | 7 | 18 | 3 | — | 3 | — |
| Soap | (% by wt.) | — | 13 | — | — | — | 1 |
| Antifoam | (% by wt.) | — | — | — | — | — | — |
| Enzyme 1 | (% by wt.) | 0.5 | 0.5 | 0.3 | — | — | — |
| Enzyme 3 | (% by wt.) | 0.5 | 0.5 | 0.3 | — | — | — |
| Opt. Brightener | (% by wt.) | 0.5 | — | — | — | — | — |
| Phosphonate1 | (% by wt.) | — | — | — | — | — | — |
| Citric acid | (% by wt.) | — | — | — | — | — | — |
| Polyvinylpyrrolidone | (% by wt.) | — | — | — | — | — | — |
| Soil release polymer | (% by wt.) | — | — | — | — | — | — |
| CMC | (% by wt.) | — | — | — | — | — | — |
| Sodium sulfate | (% by wt.) | 5.5 | 4 | 4.4 | — | — | 22 |
| Sodium chloride | (% by wt.) | — | — | — | 46 | — | 2 |
| Acetate th | (% by wt.) | — | — | — | — | — | — |
| Dosing | — | 0.5 g/l | 0.5 g/l | 80 g | 80 g | 150 g | 40 g |

TABLE 3

| Examples | | 36 | 37 | 38 |
|---|---|---|---|---|
| Phyllosilicate from Ex. 6 | (% by wt.) | 5 | — | — |
| Phyllosilicate from Ex. 14 | (% by wt.) | — | 5.2 | — |
| Phyllosilicate from Ex. 16 | (% by wt.) | — | — | 3 |
| Phosphate 2 | (% by wt.) | — | 47 | 20 |
| Sodium metasilicate ph | (% by wt.) | — | — | 47 |
| Soda | (% by wt.) | 32.7 | 27.5 | 18 |
| Sodium hydroxide | (% by wt.) | — | — | 8 |
| Sodium citrate th | (% by wt.) | 35.0 | — | — |
| Sodium percarbonate | (% by wt.) | 10 | — | — |
| Sodium perborate mh | (% by wt.) | — | 10 | — |
| NaDCC | (% by wt.) | — | — | 1 |
| Polycarboxylate 2 | (% by wt.) | 7.5 | 3.5 | — |
| TAED 2 | (% by wt.) | 5 | 2 | — |
| Enzyme 2 | (% by wt.) | 1.5 | 1.5 | — |
| Enzyme 3 | (% by wt.) | 1.5 | 1.5 | — |
| AE 2 | (% by wt.) | 1.5 | 1.5 | 3 |
| Perfume | (% by wt.) | 0.3 | 0.3 | — |
| Dosing | — | 20 g | 20 g | 2 g/l |

TABLE 4

| Example | | 39 |
|---|---|---|
| Phosphate 3 | (% by wt.) | 25 |
| Phyllosilicate from Ex. 6 | (% by wt.) | 5 |
| Soda | (% by wt.) | 1 |
| Sodium hydroxide | (% by wt.) | 1 |
| Phosphonate 2 | (% by wt.) | 0.5 |
| Polycarboxylate 3 | (% by wt.) | 2 |
| Alkanesulfonate | (% by wt.) | 1.5 |
| Water glass | (% by wt.) | 35 |
| Sodium hypochlorite | (% by wt.) | 9 |
| Water | (% by wt.) | 20 |
| Dosing | (g) | 40 |

What is claimed is:

1. A process for preparing a builder composition consisting of contacting:

a) crystalline sheetlike sodium silicate of the formula $NaMSi_xO_{2x+1}.yH_2O$, where M is sodium or hydrogen, x is a number from 1.9 to 4 and y is a number from 0 to 20, b) water and c) sulfuric acid or salt thereof having a releasable $H^+$, where a molar ratio of the crystalline sheetlike sodium silicate a) to the total amount of the releasable $H^+$ of the sulfuric acid or salt thereof c) is 15:1 to 550:1 and a molar ratio of the water b) to the total amount of the releasable $H^+$ of the sulfuric acid component c) is 3:1 to 1 000:1, and wherein said builder composition undergoes heat treating or compacting, and a step selected from the group consisting of grinding, fractionating to size, and combinations thereof to provide said builder composition having 7–21% by weight of alpha-sodium disilicate, 0–12% by weight of beta-sodium disilicate, and 65–95% by weight of delta-sodium disilicate.

2. The process of claim 1, wherein the crystalline sheetlike sodium silicate a) is a powder having an average particle size of from 0.1 to 4 000 $\mu$m.

3. The process of claim 1, wherein the sulfuric acid component c) is sulfuric acid.

4. The process of claim 1, further comprising grinding, and optionally fractionating to size said builder composition.

5. The process of claim 1, further comprising grinding and optionally fractionating to size, wherein following said compacting step, the builder composition undergoes grinding, and optionally fractionating to size.

6. The process of claim 1, further comprising grinding and optionally fractionating to size, wherein following said compacting, the builder composition undergoes grinding, and optionally fractionating to size and prior to heat treating.

7. The process as claimed in claim 6, further comprising grinding and optionally fractionating to size, wherein said builder composition undergoes heat-treating prior to compacting, grinding, and optionally fractionating according to size.

8. The process as claimed in claim 6, further comprising grinding and fractionating to size, wherein said compacting occurs prior to said grinding, optionally fractionating to size and heat-treating steps.

9. The process of claim 5, wherein the compacting is roll compacting.

10. The process of claim 1, wherein the builder composition is a powder having an average particle size of from 0.1 to 4 000 $\mu$m.

11. The process of claim 1, wherein the builder composition comprises granules having an average particle size of from 200 to 2 000 $\mu$m.

12. The process of claim 1, wherein the builder composition comprises ground granules having an average particle size of from 0.1 to 300 $\mu$m.

13. The process of claim 1, wherein the builder composition has a dissolution residue of a 0.25% strength aqueous solution at 20° C. and after stirring for 20 minutes is less than or equal to 50%.

14. A laundry detergent or cleaner comprising at least one builder composition provided by claim 1.

15. A machine dishwashing detergent comprising the builder composition provided by claim 1.

16. The laundry detergent or cleaner as claimed in claim 15, which comprises:

a) 0.5 to 98% by weight of the builder composition b) optionally 0.5 to 80% by weight of cobuilders c) optionally 1 to 50% by weight of interface-active substances d) optionally 0.5 to 80% by weight of pH regulators e) optionally 1 to 70% by weight of bleaches.

17. A component of a laundry detergent modular system which comprises 60 to 100% by weight of the builder composition provided by claim 1.

18. A water softener comprising at east one builder composition provided by claim 1.

19. The water softener as claimed in claim 18, which comprises a) 0.5 to 99% by weight of the builder composition b) optionally 0.5 to 80% by weight of cobuilders c) optionally 0 to 10% by weight of interface-active substances and d) optionally 0.5 to 80% by weight of pH regulators.

20. A detergent which comprises:

a) 70 to 99.5% by weight of the builder composition provided by claim 1, and b) 0.5 to 30% by weight of anionic, cationic, nonionic and/or zwitterionic surfactant.

21. A detergent, which comprises a) 50 to 99% by weight of the builder composition provided by claim 1, and b) 0.01 to 10% by weight of dye.

22. The laundry detergent of claim 14, which is in tablet form.

* * * * *